United States Patent [19]

Majima

[11] 4,301,874

[45] Nov. 24, 1981

[54] PILE OR SHEET-PILE DRIVER

[76] Inventor: Keichiro Majima, 1380-2, Oaza Nishi Toyoi, Kudamatsu-shi, Yamaguchi-ken, Japan

[21] Appl. No.: 92,371

[22] Filed: Nov. 8, 1979

[51] Int. Cl.[3] ..... E02D 7/10

[52] U.S. Cl. ..... 173/152

[58] Field of Search ..... 173/152, 130, 49; 175/55, 56; 405/232

[56] References Cited

U.S. PATENT DOCUMENTS 3,502,160 3/1970 Herz ..... 173/49

FOREIGN PATENT DOCUMENTS 2333226 12/1974 Fed. Rep. of Germany ..... 173/49

2708252 9/1977 Fed. Rep. of Germany ..... 173/49

52-26663 2/1977 Japan ..... 173/49

*Primary Examiner*—Ronald Feldbaum

*Attorney, Agent, or Firm*—Stevens, Davis, Miller & Mosher

[57] ABSTRACT

Pile or sheet-pile driver comprising a vertically movable member to be vertically driven by a hydraulic cylinder supporting a vertically movable chucking device having a pair of chucking fingers to be brought close to or away from each other by the hydraulic cylinder; an elastic member and longitudinal vibrators installed between the vertically movable member and the chucking fingers. The chucking device is designed such that a pile or a sheet-pile held upright can be placed sidewise into position between the chucking fingers.

13 Claims, 18 Drawing Figures

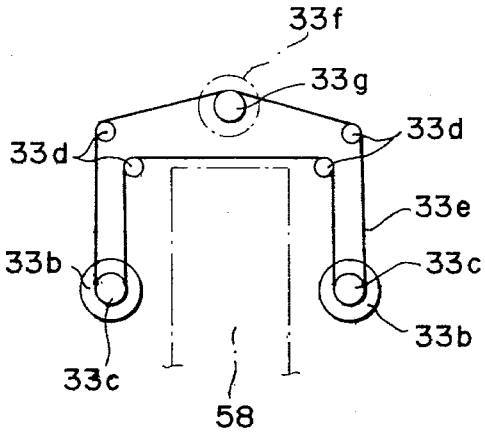
FIG. 8
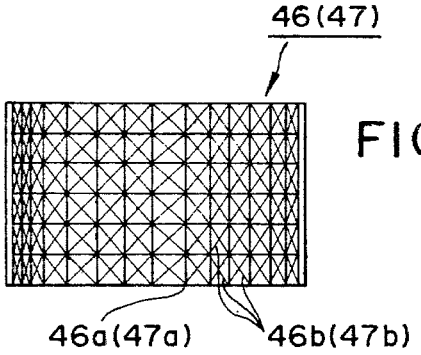
FIG. 9
FIG. 10
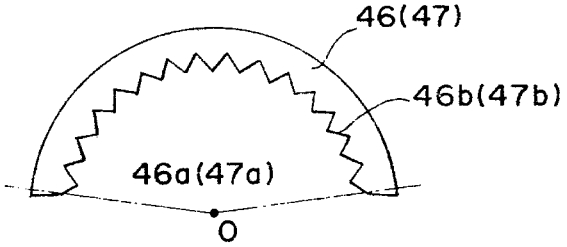

FIG. 12
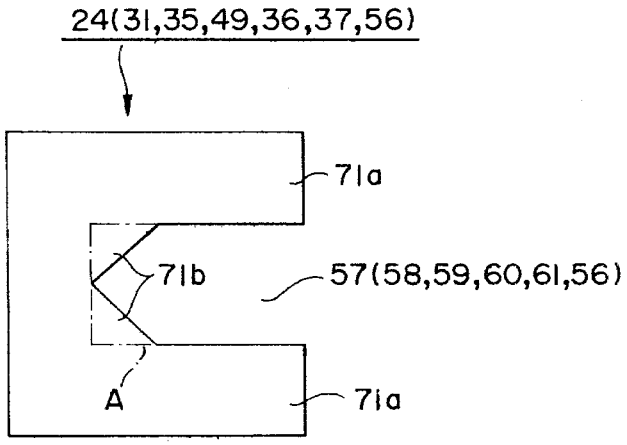
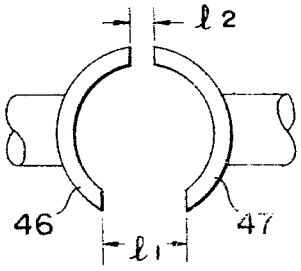
FIG. 13

PILE OR SHEET-PILE DRIVER

BACKGROUND OF THE INVENTION

The present invention relates to a pile driver designed such that an upright pile or sheet-pile of H-steel, concrete or wood can be placed sidewise into position between a pair of chucking fingers.

Pile or sheet-pile drivers have been available which are designed such that a pile or sheet-pile held in a chucking device downwardly urged by a spring can be driven into the ground by applying a vertical vibration to the chucking device.

In such a pile or sheet-pile driver, a pile is set into position in the chucking device by putting the pile through a vertical through-hole from upside to downside.

For this purpose, first the tip of the pile has to be lifted high above the pile driver, to be moved to a position just over the through-hole and then to be lowered into the hole. Since the pile is lifted by a crane, it is liable to swing in lateral direction, which makes it troublesome and time-consuming to place the pile into position in the chucking device.

SUMMARY OF THE INVENTION

The primary object of the present invention is to provide a pile or sheet-pile driver designed such that insertion spaces opening in a vertical and lateral direction are provided in the chucking device and its supporting member and through these openings a pile held upright can be easily and swiftly placed sidewise into position between the fingers of the chucking device.

Another object of the present invention is to provide a pile or sheet-pile driver designed such that only the chucking device can jut out in a lateral direction between the mount and the vertically movable member, thereby making it unnecessary to provide the vertically movable member or a member installed between the vertically movable member and the mount, with an opening for sidewise reception of the pile, with the result that these members can be made stronger and the number of work steps for these members can be reduced.

Still another object of the present invention is to provide a pile or sheet-pile driver designed such that the chucking device can be fitted to the vertically movable member in a manner free to move vertically, by means of a guide rod and a support member, whereby the chucking device is made vertically movable in opposition to the opening for pile reception so that a pile held in the chucking device can be driven into the ground without touching the member supporting the chucking device.

Still another object of the present invention is to provide a pile or sheet-pile driver designed such that a single power-transmitting belt for two longitudinal vibrators is laid approximately in U-letter fashion along the opening for pile reception, so that the belt may not stand in the way of a pile being inserted.

Still another object of the present invention is to provide a pile or sheet-pile driver designed such that one of the chucking fingers is held, at a fixed position, opposite the opening for pile reception, while the other finger is moved to come close to or away from the former finger, so that a pile can be held at a definite position in the opening for pile reception, whereby in the same manner as above, the pile held in the chucking device can be driven into the ground without touching a member supporting the chucking device.

Still another object of the present invention is to provide a pile or sheet-pile driver designed such that a plurality of chucking devices are arranged up and down so that a pile can be held at a definite position in the opening with sufficient force, though the holding ability of each chucking device may be small.

Still another object of the present invention is to provide a pile or sheet-pile driver designed such that the chucking member and the hydraulic cylinder to move it are held approximately to the U-letter fashion chucking fixture, which is supported by a support member with limited freedom to move in the axial direction of the hydraulic cylinder, whereby the held position of the pile can be changed to a certain extent so that even when the inserted position is slightly wrong, the pile can be held in the opening without contacting the member supporting the chucking device.

Still another object of the present invention is to provide a pile or sheet-pile driver designed such that the chucking device can be swung laterally in the laterally moving direction of the chucking fingers, whereby the force to cause the pile to slip out from between the chucking fingers may be avoided.

Still another object of the present invention is to provide a pile or sheet-pile driver designed such that a pair of chucking fingers are arranged approximately in semi-arc fashion and the finger-end gap side from which the pile is inserted is made wider than the gap on the opposite side, whereby a short movement of chucking fingers facilitates the positioning of a pile between the fingers without a lowering of the holding power.

Still another object of the present invention is to provide a pile or sheet-pile driver designed such that the mount consists of a fixed member with a fixture to other members, a slidable member fitted to the fixed member in such a manner as to be movable in the same direction as the lateral movement of the chucking fingers (normal to the pile-inserting direction), and a hydraulic cylinder installed between the slidable member and the fixed member, whereby even when inserted a pile tilting to one side, can be centrally in the opening by driving the slidable member to shift in a normal direction to the pile insertion by the hydraulic cylinder.

These objects, features and advantages of the invention will become more apparent upon a reading of the following detailed specification and drawings.

BRIEF DESCRIPTION OF THE DRAWINGS

FIG. 8 shows a layout of two longitudinal vibrators.

FIG. 9 is a front elevation view of a chucking finger.

FIG. 10 is a plan view of FIG. 9.

FIG. 12 is a plan view showing the geometrics of the vertically movable member, spring bearing plate, holding member, and chucking fixture.

FIG. 13 is a plan view showing a different embodiment of the chucking finger.

DETAILED DESCRIPTION OF THE INVENTION

One embodiment of the present invention is described by reference to the attached drawings.

Figure 1:
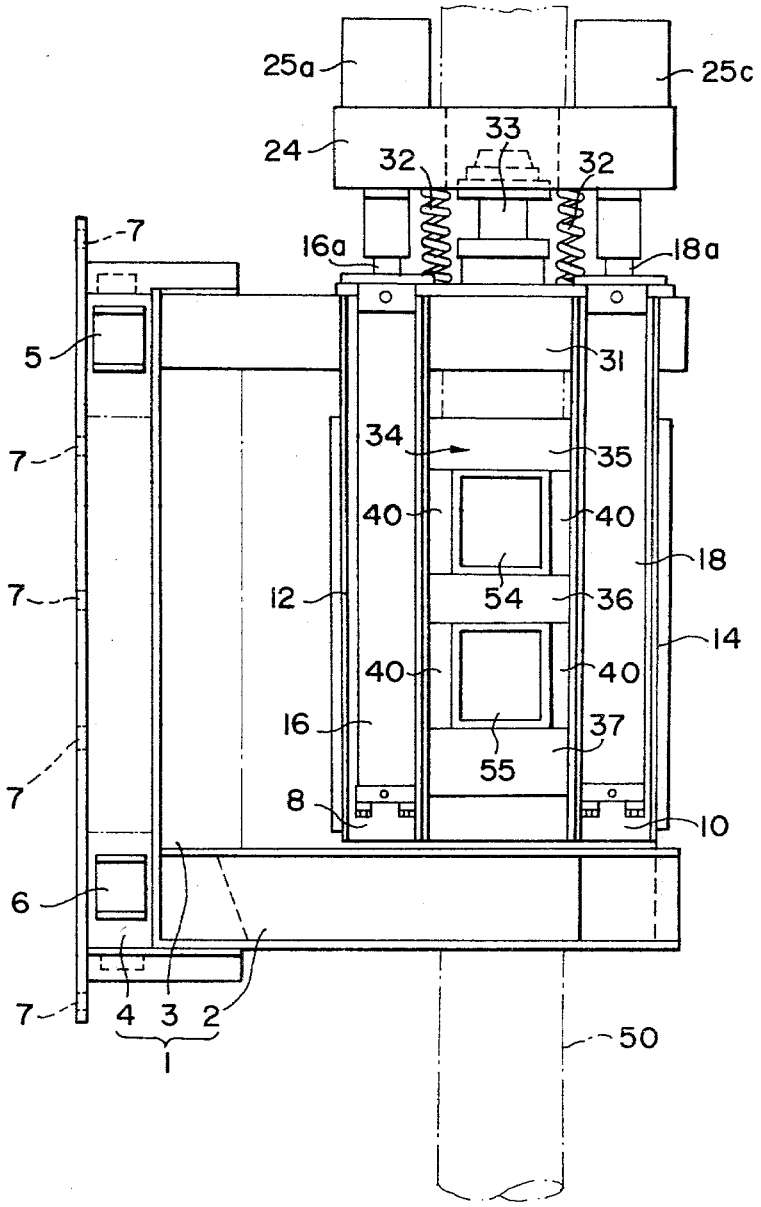
FIG. 1 is a side view showing one embodiment of a press-in device for a pile or sheet-pile according to the present invention.

In FIG. 1, 1 is a mount, which comprises a lower supported stand 2, a slidable member 3, a fixed member 4 and hydraulic cylinders 5, 6. Slidable member 3 is fitted to one end of lower support stand 2 and extends upwardly at a position opposite to an opening for pile reception to be described later. Slidable member 3 is supported by the upright fixed member 4 and is free to move in the lateral direction (normal to the paper surface in FIG. 1).

Such arrangement of the slidable member 3 and the fixed member 4 directed upwardly at a position opposite to the opening for a pile reception makes it easy to fit the fixed member 4 to a mobile machine like a vehicle, without the fixed member 4 or the slidable member 3 standing in the way of a pile to be received in the opening.

Figure 2:
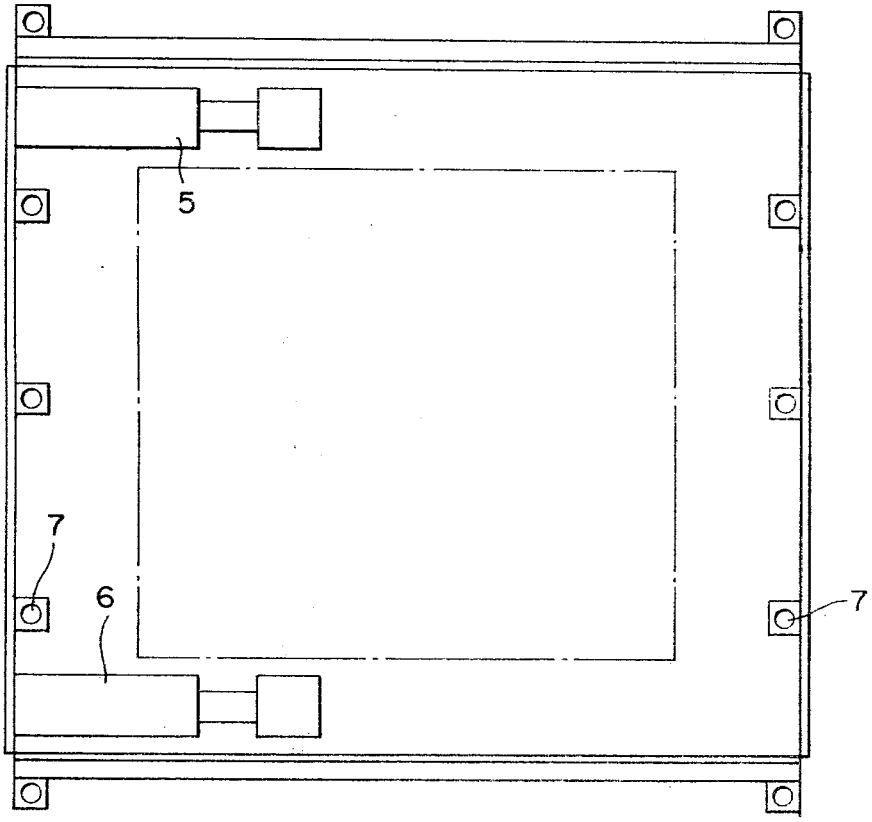
FIG. 2 is a side elevation view of a fixed member supporting the slidable member of FIG. 1.

As indicated in FIG. 2, on both sides of the fixed member 4 there are bored a plurality of fitting holes 7, extending from top to bottom at specific intervals.

The hydraulic cylinders 5, 6 are provided at the top and bottom of the fixed member 4, with their axes lying in the moving direction of the slidable member 3 so that the expansion and contraction of these cylinders 5, 6 cause a lateral movement of the slidable member 3. The slidable member 3 is adapted to be moved in a direction lateral to the fixed member 4.

Thus by shifting a slidable member 3 in a direction normal to the pile-receiving direction a pile can be set centrally in the opening for its reception; and for this purpose an opening for pile reception is provided as described later.

Figure 3A:
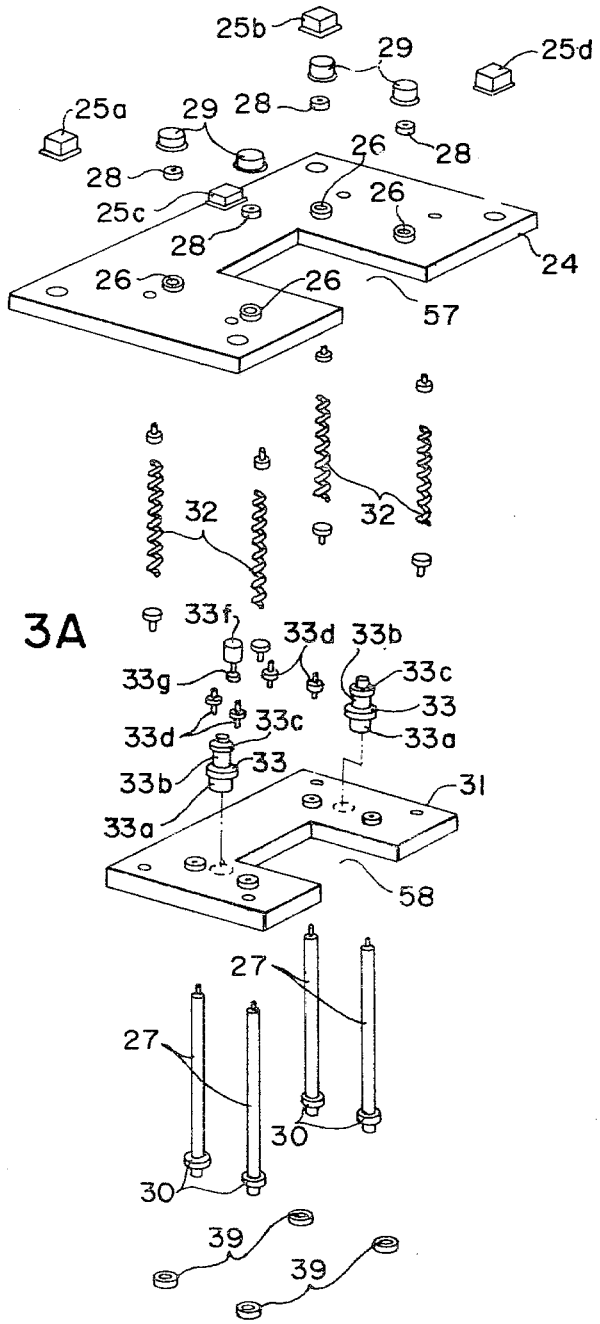
FIGS. 3(*a*) and 3(*b*) are oblique views of separate elements in the device of FIG. 1.
Figure 3B:
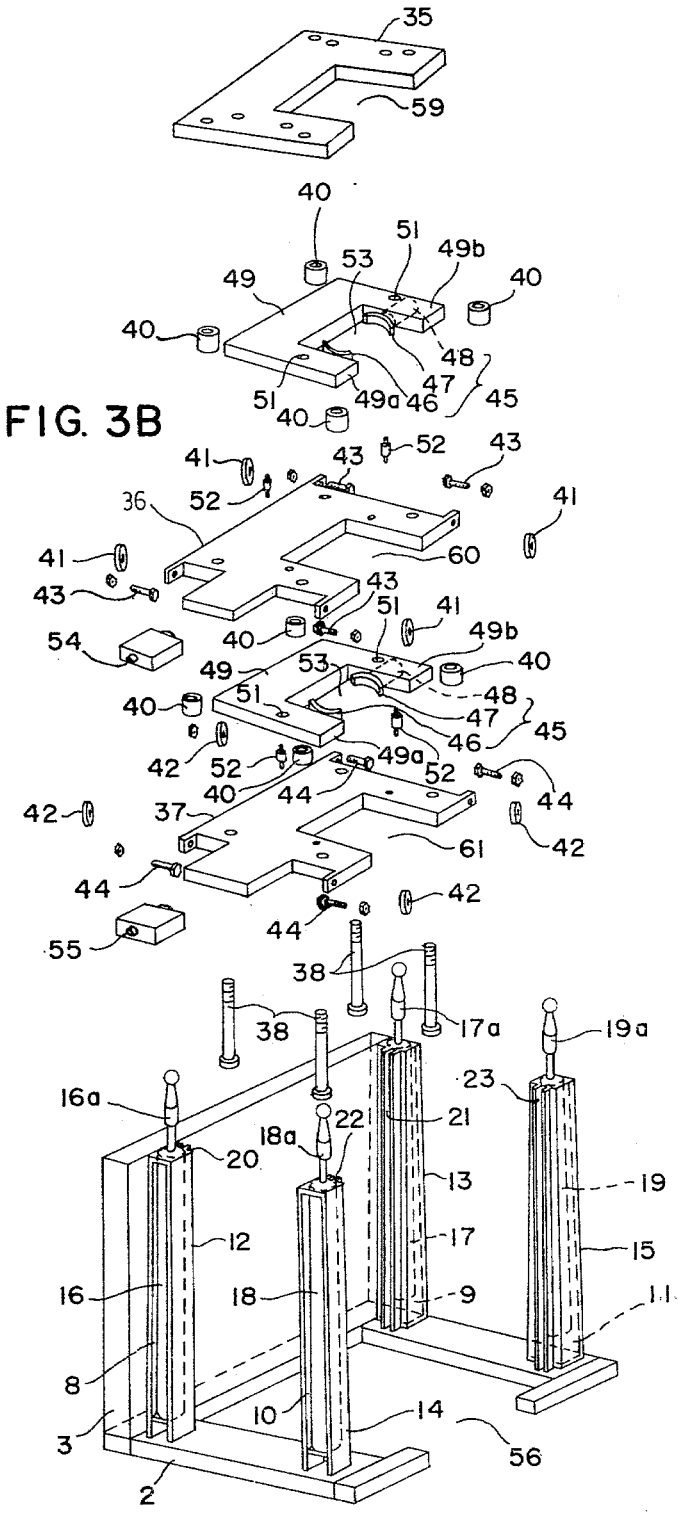
Figure 4:
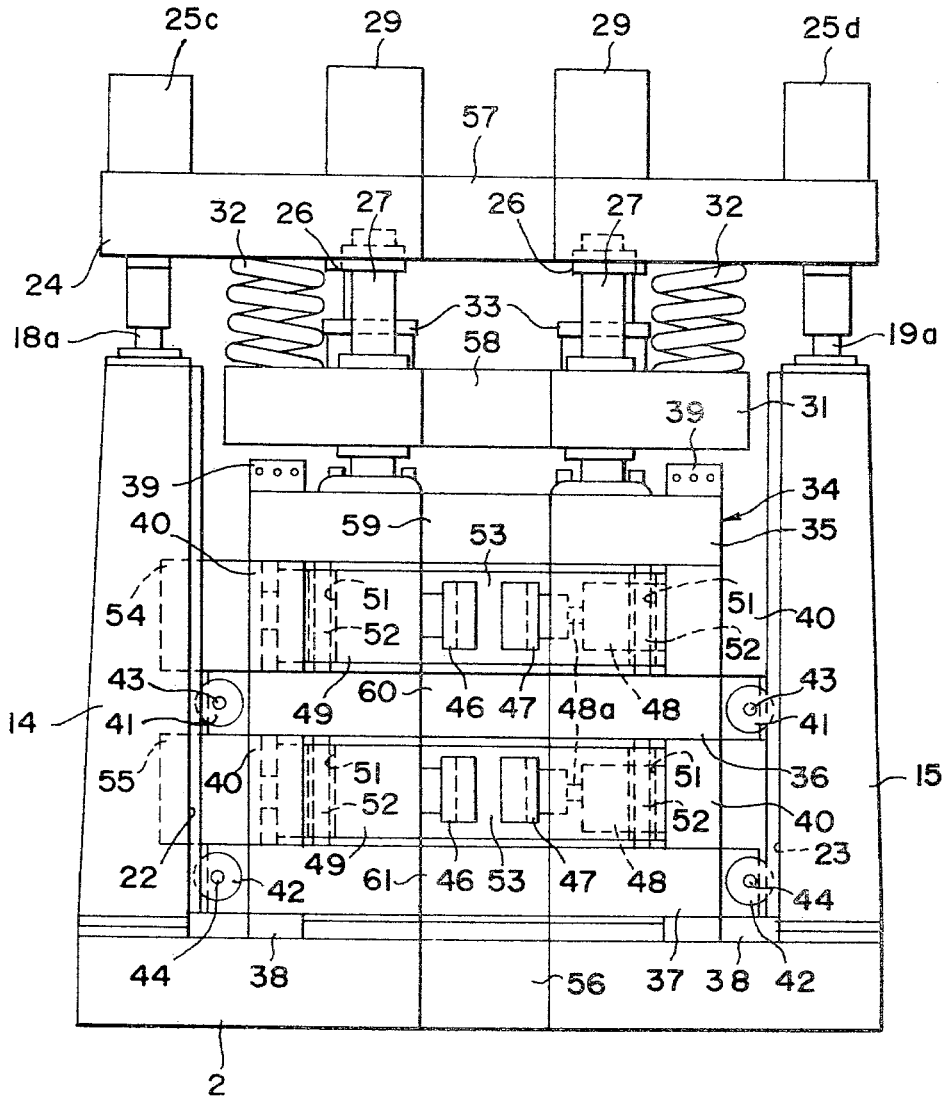
FIG. 4 is a right side view of the device of FIG. 1.
Figure 5:
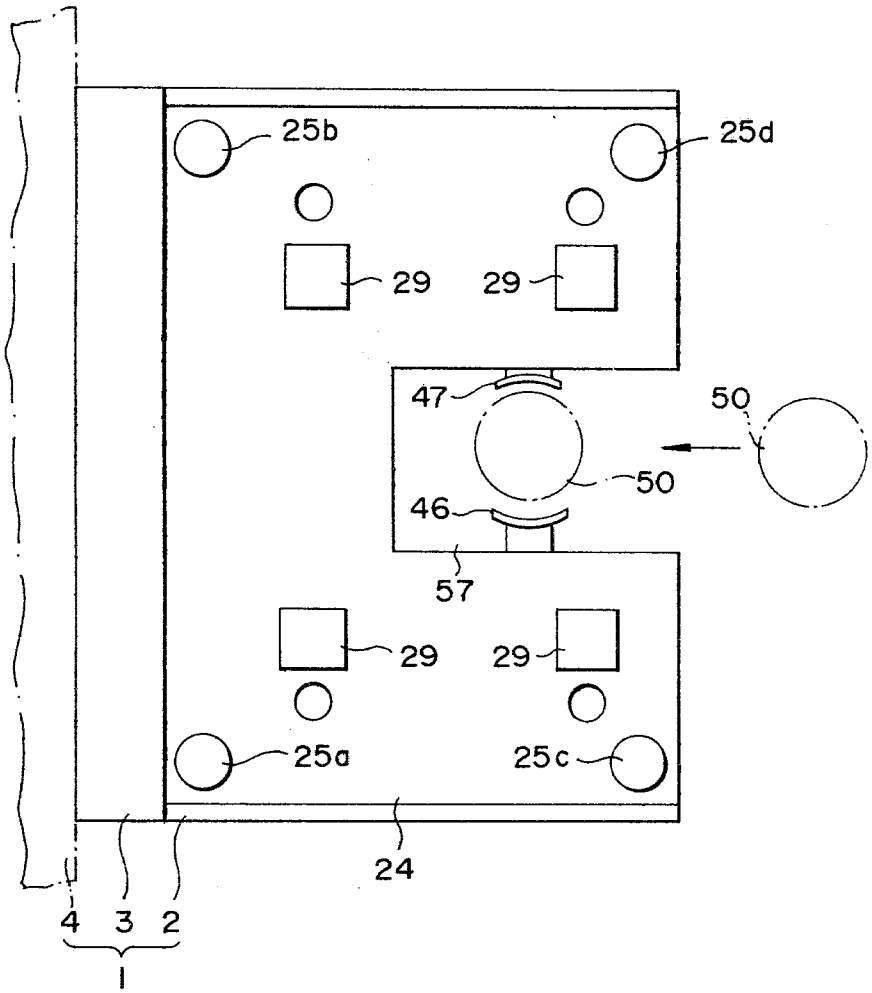
FIG. 5 is a plan view illustrating the relation between a pile and the device of FIG. 1.

At the four corners of the lower supporting stand 2 there are erected the posts 12, 13, 14, 15 with internal cavities 8, 9, 10, 11 respectively (see FIG. 3(*b*)). Posts 12, 13, 14, 15 hold in their cavities 8, 9, 10, 11 hydraulic cylinders 16, 17, 18, 19 as lifting means. The upper ends of the piston rods 16*a*, 17*a*, 18*a*, 19*a* of respective cylinders 16, 17, 18, 19 run through the tops of posts 12, 13, 14, 15 and jut out above these posts.

On the opposed surfaces of the posts 12, 13 located on the slidable member side there are provided guide grooves 20, 21 extending vertically. On the opposed surfaces of the posts 14, 15 there are similar grooves 22, 23 formed.

Figure 6:
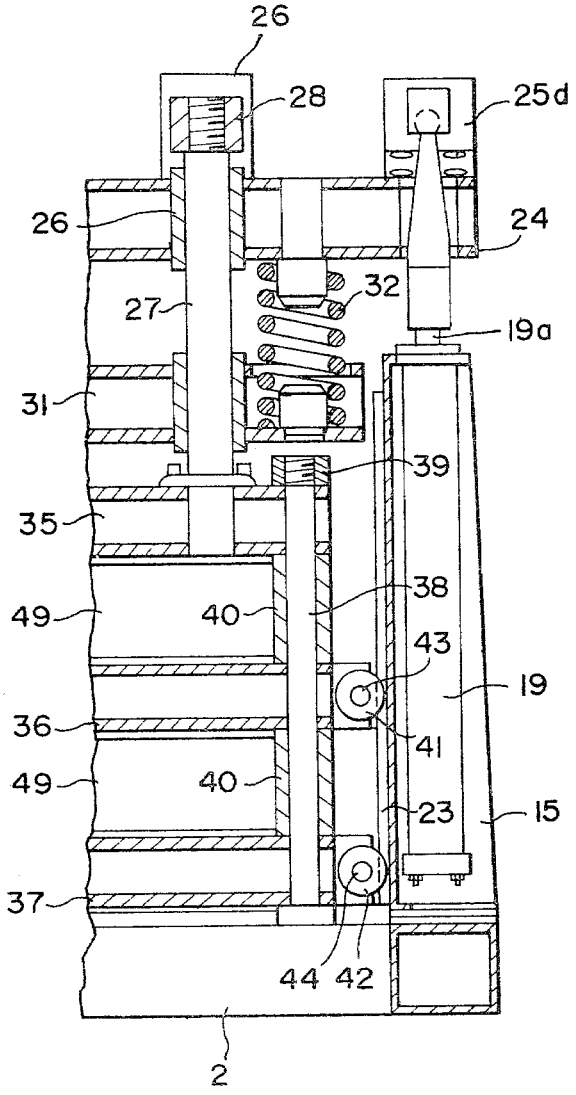
FIG. 6 is a partial section view of the device of FIG. 1.

The top ends of the piston rods 16*a*, 17*a*, 18*a*, 19*a* run through the vertically movable member 24 and jut out upwardly (see FIG. 6). The top ends of these piston rods are fitted to the top surface of the vertically movable member 24 by means of universal joints 25*a*, 25*b*, 25*c*, 25*d* (see FIGS. 1–6).

The vertically movable member 24 has sleeves 26 fitted, which vertically run through member 24. There are four such sleeves 26, each of which is fitted at a spot separated by a specific distance from the corner of the vertically movable member 24.

Four guide rods 27 slidably run through respective sleeves 26. At the top of guide rods 27 are screwed nut members 28; 29 is a top cover for guide rod 27. At the bottom of the guide rod 27 is juttingly provided a flange 30. Below the vertically movable member 24 is provided a spring bearing plate 31, which is free to move vertically along the guide rod 27. Each nut member 28 and flange 30 limit the movable range of guide rod 27.

Between the four corners of spring bearing plate 31 and the vertically movable member 24 there is inserted a compressible coil spring 32 as an elastic member. Further between spring bearing plate 31 and the vertically movable member 24 there are installed on both sides of the pile-receiving opening 57 longitudinal vibrators 33, 33 to give vertical vibration to a chucking device to be described. The longitudinal vibrator 33 can be a cylinder type, a cam type or other types. Practically it is desirable that longitudinal vibrator 33 be one as illustrated, in which the reciprocation of the piston rod (not shown) of the cylinder 33*a* in the oil chambers (not shown) before and after a piston (not shown) of a double-action ram type cylinder 33*a* is caused by an oil-pressure pump (not shown) and an oil tank (not shown) alternately operated by the rotary valve 33*b*. The pulley 33*c* attached to the input rotating shaft of the rotary valve 33*b* of these two longitudinal vibrators 33, 33 is coupled with the output shaft 33*g* of a motor 33*f* supported on the vertically movable member 24, over the four pulleys 33*d* supported on the vertically movable member 24 and over the belt 33*e* (FIG. 8). Thus the two rotary valves 33*b* can make a synchronized rotation (see FIG. 8). Since, as indicated in FIG. 8, the belt 33*e* is laid over four pulleys 33*d* in U-letter fashion along the opening 58 without obstructing the pile-receiving opening 58, there is no likelihood of the pile insertion being hindered.

At the bottom of the guide rod 27 there is fitted a support member 34, which is composed of three flat holding members 35, 36, 37, the bolts 38 and the nuts 39 to integrate holding members 35, 36, 37, at four corners as a single unit, and the spacers 40 to hold members 35, 36, 37 up and down with a constant spacing. The bottom of the guide rod 27 is fixed to the topmost holding member 35.

On the side surface of the holding members 36, 37 there are rotatably held the guide wheels 41, 42 over the shafts 43, 44, partially fitting into the guide grooves 20, 21, 22, 23.

Figure 7:
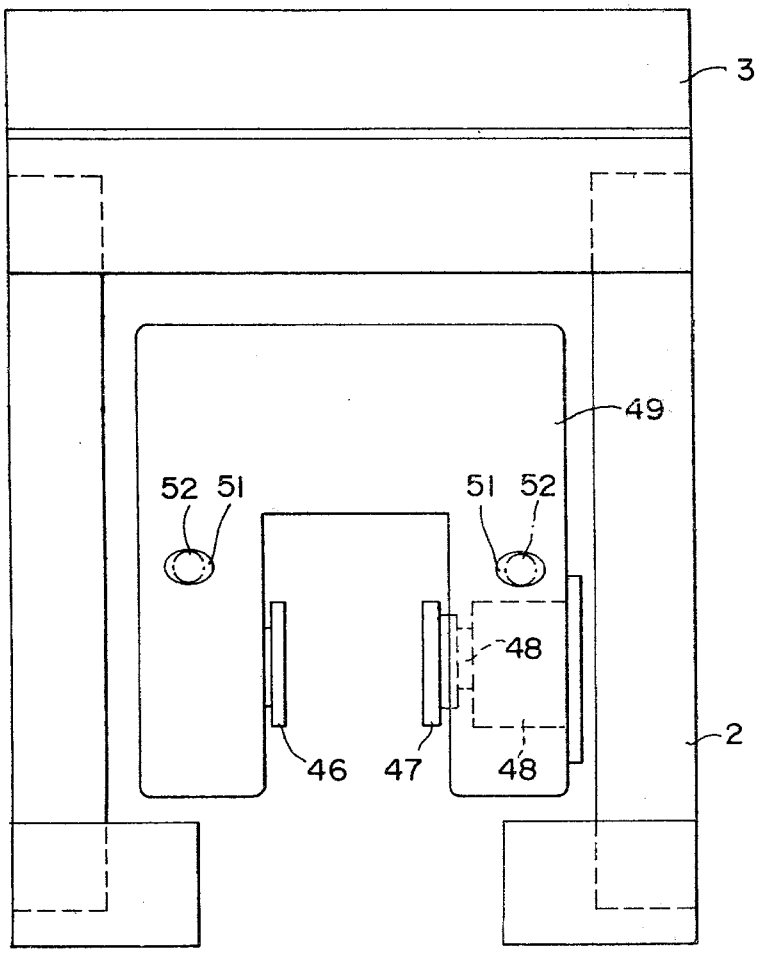
FIG. 7 is a plan view illustrating the relation between the lower supporting mount and the chucking device.

Between the holding members 35 and 36 and between 36 and 37 come respectively the chucking devices 45, 45. The chucking devices 45 has a pair of chucking fingers 46, 47 and a hydraulic cylinder 48 with a piston rod stroke of about 50–100 mm. One of the chucking fingers 46 is fixed to an opposite piece 49*a* of the U-letter shaped chucking fixture 49, while the other finger 48 is fixed to an opposite piece 49*b* of fixture 49 (see FIGS. 4 and 7). The tip of the piston rod 48*a* of the hydraulic cylinder 48 faces the center of the finger 46. The other finger 47 is attached to the tip of the piston rod 48*a*. The opposed holding surfaces 46*a*, 47*a* of the two chucking fingers 46, 47 form a semi-arc along the pile 50 (see FIG. 5).

As indicated in FIGS. 9 and 10, sharp projections 46*b*, 47*b* are provided across holding surfaces 46*a*, 47*a*. The chucking fingers 46, 47 with such surfaces 46*a*, 47*a* are made of a harder material than the pile 50; for instance, when the pile 50 is a concrete one, the material is desirably SK-3 or the like. Meanwhile, the surfaces 46*a*, 47*a* are desirably formed approximately in a semi-arc as illustrated in FIG. 10 to give a large pile-holding force. However, it is not desirable that surfaces 46*a*, 47*a* be formed in a perfect semi-arc.

It is desirable that the surfaces be formed in a slightly modified semi-arc so that the chucking fingers 46, 47 do not hit each other, when the projections 46*b*, 47*b* bite into the pile 50. The height of projections 46*b*, 47*b* is desirably about 10 mm.

The holes 51, 51 vertically run through the opposite pieces 49*a*, 49*b* which are fitted with the chucking fingers 46, 47. The cross section of holes 51, 51 is somewhat elongated in the axial direction of the hydraulic cylinder 48. The shaft 52 passing through the hole 51 is fixed to the holding members 35, 36, 37. The chucking fixture 49 is fitted to the support member 34 by means of hole 51 and shaft 52 in such manner that a certain displacement in the axial direction of the hydraulic cylinder 48 (that is, in the movable direction of the chucking finger 47) can be permitted.

This movable direction of the chucking fixture 49 agrees with the movable direction of the slidable member 3.

Between the chucking fingers 46 and 47 is constituted a pile-receiving space 53 opening upward, downward and sideway (in a direction normal to the axis of the hydraulic cylinder 48).

Between the holding member 36 and the chucking fixture 49 and between the holding member 37 and the chucking fixture 49 there are installed respectively the lateral vibrators 54, 55. These vibrators 54, 55 are located such that they generate vibrations in the axial direction of the hydraulic cylinder 48. Thus, generation of a force which causes the pile to get out sidewise from between the chucking fingers 46, 47, when a lateral vibration is given to the chucking device 45 can be prevented. Similarly longitudinal vibrator 33 may be utilized in the same manner as the lateral vibrators 54, 55 with similar synchronization.

In the above-mentioned lower support stand 2, the vertically movable member 24, the spring bearing plate 31 and the holding members 35, 36, 37, are constituted respectively of the pile-receiving spaces 56, 57, 58, 59, 60, 61 which open on the opposite side to the fixed member 4. These spaces 56, 57, 58, 59, 60, 61 are aligned in vertical direction. The chucking fingers 46, 47 face these spaces.

The frequency f and the amplitude h of the longitudinal vibrator 33 and the lateral vibrators 54, 55 can be changed by controlling the revolution of a motor which drives these vibrators. The longitudinal vibrator 33 is controlled in accordance with the pile weight w and the lateral vibrators 54, 55 are controlled in accordance with the soil quality. The control conditions are given in Tables 1 and 2.

TABLE 1

| | Longitudinal vibrator | |
|---|---|---|
| w | f | h |
| low | high | low |
| high | low | high |

TABLE 2

| | Lateral vibrator | |
|---|---|---|
| Soil | f | h |
| viscous | low | high |
| sandy | high | low |

The working condition of the pile-driver thus constituted is to be described here.

Figure 11:
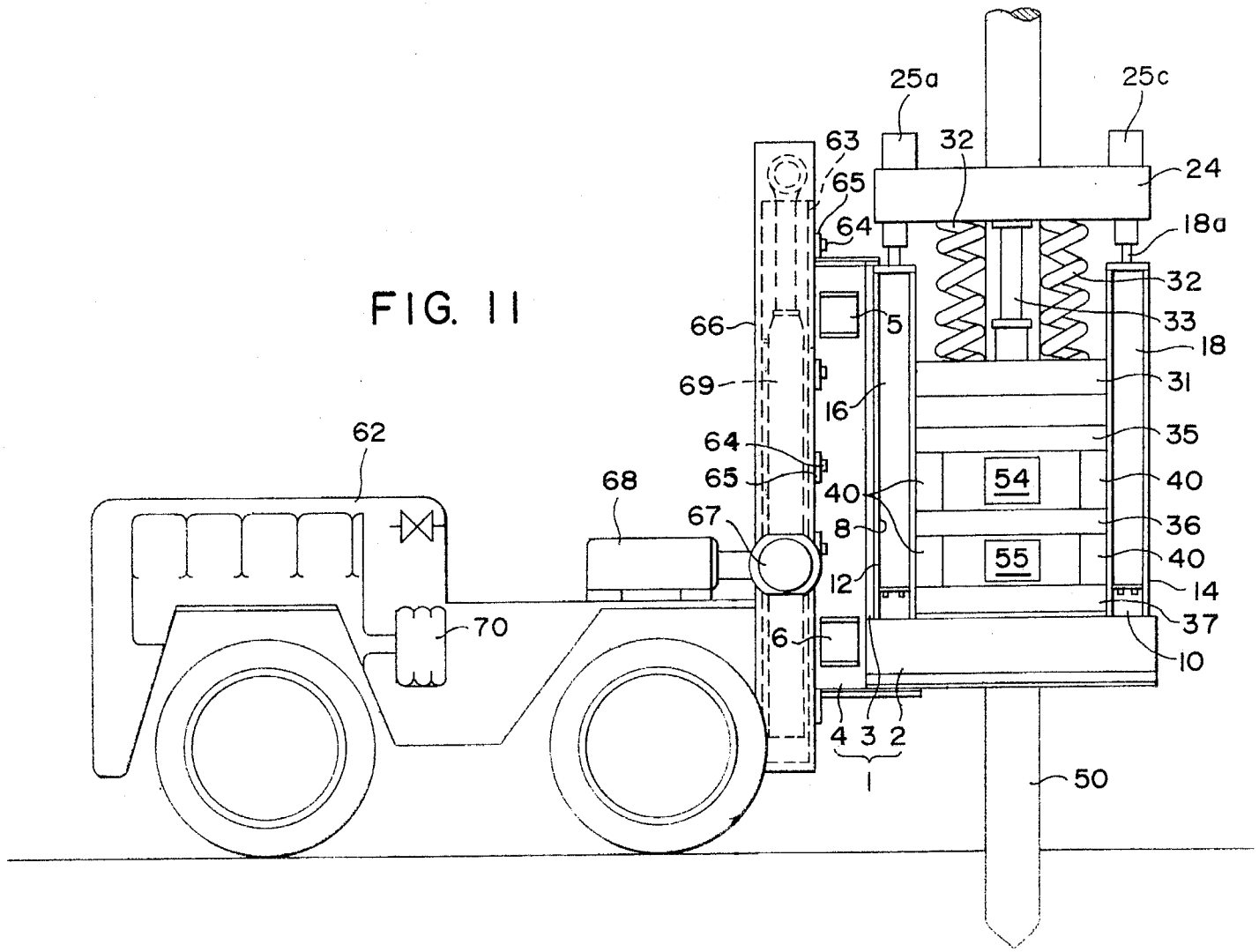
FIG. 11 is a side view showing the working state of the device of FIG. 1.
Figure 14:
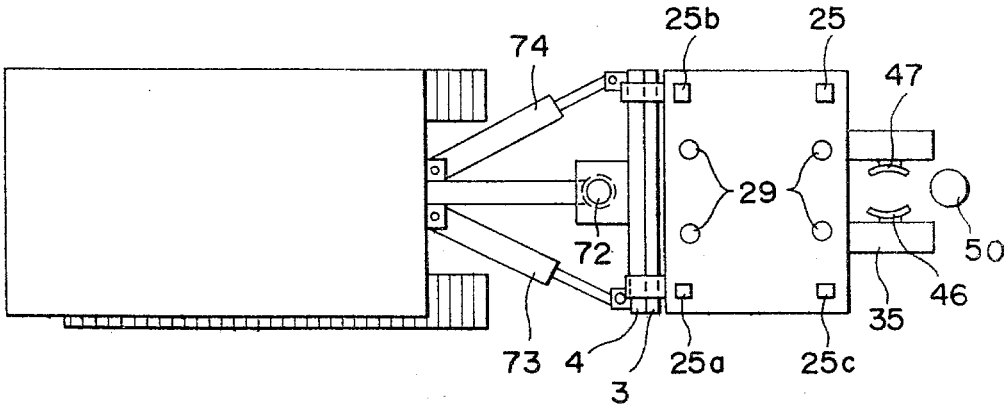
FIG. 14 is a plan view illustrating another embodiment of the present invention.
Figure 15:
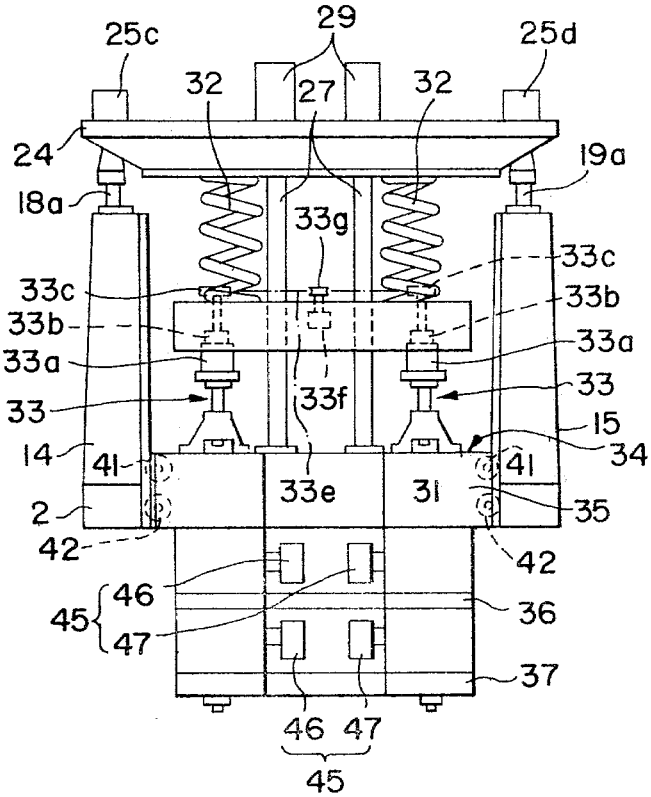
FIG. 15 is a front view of the device of FIG. 14.
Figure 16:
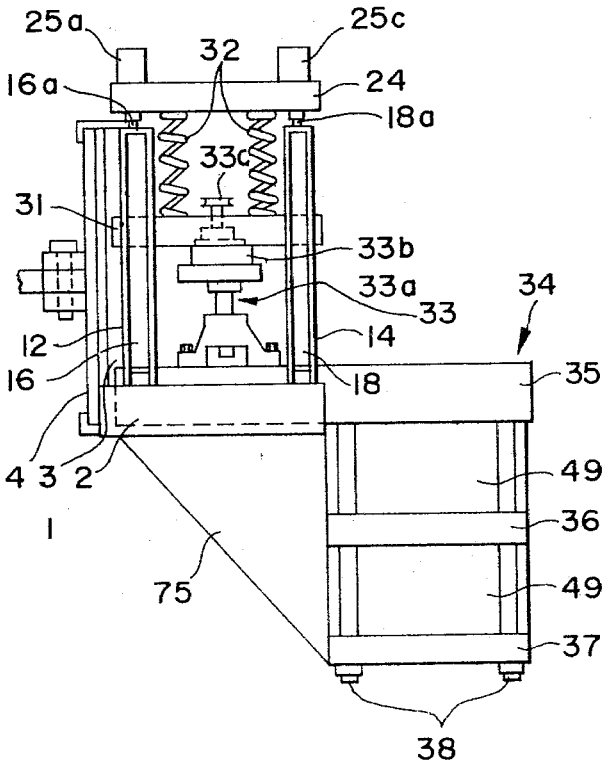
FIG. 16 is a partial side view of the device of FIG. 14.
Figure 17:
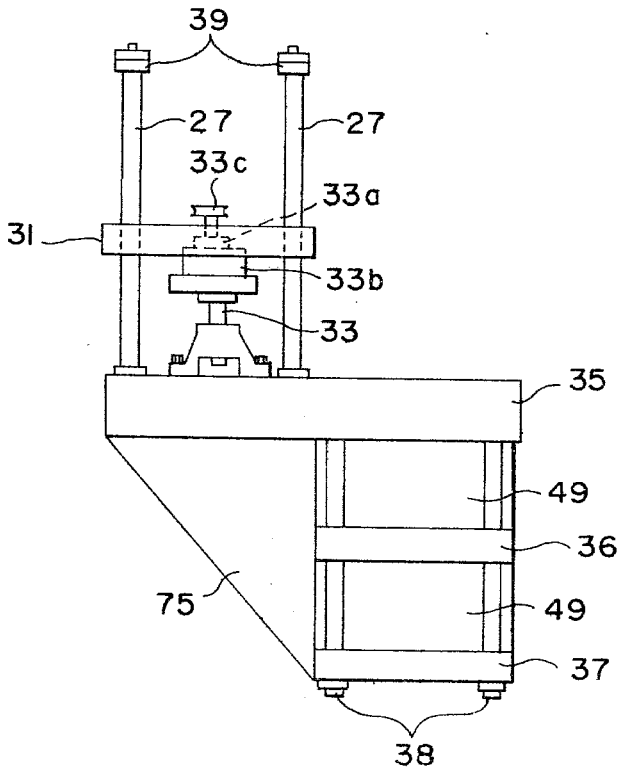
FIG. 17 is a side view illustrating the fitted relation between the guide rod and the chucking device.

FIG. 11, illustrates an example of the pile driver attached to the lifting member 63 of a fork-lift 62. Attachment of the driver to the lifting member 63 is done by inserting the bolt 64 of the lifting member 63 into the hole 7 and applying the nut 65 to bolt 64. The lift assembly 66 which supports the lifting member 63 is free to move vertically and is tiltable longitudinally around the shaft 66, the tilting being done by a hydraulic cylinder 68. The lifting member 63 is vertically movable by a hydraulic cylinder 69. These cylinders 68, 69 are operated by a hydraulic pump 70 mounted on the fork-lift 62. Also the hydraulic cylinders 5, 6, 16, 17, 18, 19, 48 in the pile-driver are connected to oil-pressure pump 70 for operation.

The pile driver thus mounted on the fork-lift 62 can be freely transported. For the purpose of holding a pile 50 in this driver, at first the pile 50 is made to stand upright by means of a crane not shown; the pile-insertion openings 53, 56, 57, 58, 59, 60, 61 are brought in opposition to the pile 50; and then the fork-lift 62 is moved up to the pile 50, to receive the pile into said openings 53, 56, 57, 58, 59, 60, 61. Next, the cylinders 5, 6 are extended to slide the slidable member 3 in lateral direction, whereupon the chucking finger 46 is brought up to the pile 50 and the holding surface 46*a* of finger 46 comes into contact with the pile 50.

Thereafter, the operation of the cylinder 48 causes the finger 47 to come close to the pile 50; and when the holding surface 47*a* of the finger 47 bears against the pile 50, the pile 50 can be gripped between fingers 46, 47. Before the pile 50 is gripped, the piston rods 16*a*, 17*a*, 18*a*, 19*a* of the cylinders 16, 17, 18, 19 have to be displaced upwardly.

After the pile 50 is thus held in the driver, the cylinders 16, 17, 18, 19 are operated to act downwardly to urge the piston rods 16*a*, 17*a*, 18*a*, 19*a* downwardly, thereby causing the longitudinal and lateral vibrators to work.

In this way the pile 50 is given a downward penetrating force by the cylinders 16, 17, 18, 19 and at the same time vibrated longitudinally and laterally to be driven into the ground.

In the example illustrated above, the member provided with a pile-insertion space is formed approximately in U-letter shape, but for the sake of an increased strength it is desirable that, as indicated by a wavy line A in FIG. 12, triangular reinforcements 71*b*, 71*b* be provided inside the base of the opposite pieces 71*a*, 71*a*. Further it is desirable for the sake of weight reduction, that reinforcement be done by connecting the plates of indicated shape with two ribs.

It is also possible, as indicated in FIG. 13, to make the gap $l_1$ at one end of the fingers 46, 47 wider than the gap $l_2$ at the other end, so that a pile can be easily inserted through the gap $l_1$, even if the stroke of the finger 47 is short and the holding ability of the fingers 46, 47 can be increased.

The holding surfaces of the fingers 46, 47 may be designed flat to facilitate the holding of a sheet pile.

FIGS. 14 to 17 illustrate another embodiment of the present invention. In this embodiment the chucking device 45 is supported on a support member 34 extending in lateral and downward directions from between the mount 1 and the vertically movable member 24, thereby making it needless to provide a pile-receiving opening in the vertically movable member 24 and in a member installed between member 24 and the mount 1, with the result that the number of work steps can be cut down and the strength can be increased.

In this example the locations of the longitudinal vibrator 33 and the guide wheels 41, 42 are changed and a different machine is employed to support the pile-driver.

Namely, the guide wheels 41, 42 are fitted to the same holding member 35 and accordingly the relative position between wheels 41, 42 can be made exact. Since the longitudinal vibrator 33 comes between the spring bearing 31 and the holding member 35, a vibration noise can be avoided.

In this example with no pile-receiving space taken in the spring bearing 31, there is no need for U-letter arrangement of the belt **33*e* and accordingly the pulley 33*d* in the former example is rendered unnecessary. In the figure, the item 75 is a triangular reinforcement provided at the holding members 35, 36, 37**.

In this example the fixed member 4 is attached, free to move in the horizontal direction, to the front of the vehicle via the shaft 72 and this member can be moved in a horizontal direction by a pair of hydraulic cylinders 73, 74. In this example there is no lateral vibrator installed; it is immaterial whether such a vibrator is present or not, but it would be desirable to install one as in the former example. The rest of this example is the same as in the former example; therefore the same symbols are given for like parts with description omitted.

As described above, according to the present invention, a pile-receiving space is taken vertically and laterally in the chucking device and its mount; and therefore, a pile can be readily and swiftly inserted sidewise into the pile-receiving space and gripped between the chucking fingers, instead of conventionally being lifted high above the driver.

Moreover, if only the chucking device is laterally extended from between the mount and the vertically movable member, there will be no need of providing an opening to take the pile sidewise in the vertically movable member or in a member installed between said member and the mount, thereby saving the work steps for these members and increasing their strength.

Furthermore, if the vertically movable member is made to support the chucking device, free to move vertically, by means of a guide rod and a support member so that the chucking device can always come opposite to the pile-receiving opening, the pile as held in the chucking device will be able to be driven into the ground without being obstructed by the member supporting the chucking device.

Furthermore, if a single belt for power transmission to the two longitudinal vibrators is stretched U-letter fashion in the pile-receiving space, said belt will not hinder the pile being inserted sidewise.

Furthermore, if it is so designed that one chucking finger is held at a position opposite to the pile-receiving opening while the other finger is movable up to or away from the former finger, in the same way as above a pile as held in the chucking device will be able to be driven into the ground without being obstructed by the member supporting the chucking device.

Furthermore, if a plurality of chucking devices are arranged one above another, a sufficient force to hold the pile in position will be attained, even though the force given by each chucking device may be small.

Furthermore, if the chucking fingers and the hydraulic cylinder to drive them are carried on a U-letter shaped chucking fixture and this chucking fixture is supported, free to move within small limits in the axial direction of the hydraulic cylinder, by a support member, it will be possible to permit certain changes in the pile-holding portion, and therefore to hold the pile in the pile-receiving space without contact with a member supporting the chucking device, even though the pile-inserting position is slightly wrong.

Furthermore, if it is so designed that a lateral vibration can be given to the chucking device in the direction of the lateral movement of the chucking finger, it will be possible to prevent generation of a force which causes the pile to slip out sidewise from between the chucking fingers, when a lateral vibration is given to the chucking fingers.

Furthermore, if a pair of chucking fingers are provided in approximately semi-arc fashion and at the same time the gap between the fingers at the pile-receiving side is made wider than the gap at the opposite side, a pile will be able to be easily gripped between the fingers by a short movement of the fingers.

Furthermore, if the mount is constituted of a fixed member with a fixture to other members, a slidable member attached, free to move in the same direction as the movement of the chucking finger (normal to the pile insertion), to the fixed member and a hydraulic cylinder inserted between the slidable member and the fixed member, a pile will be able to be set centrally in the pile-receiving space by moving the slidable member in a normal direction to pile insertion by the hydraulic cylinder, even when the pile is inserted, tilting to one side.

Furthermore, if the fixed member is located on the opposite side to the pile-receiving space and set in a vertical direction, the fixed member will not stand in the way of pile insertion and the fixed member will be easy to install in a movable unit, such as a vehicle.

What is claimed is:

1. Pile or sheet-pile driver comprising:

a mount;

a plurality of hydraulic cylinders fitted upright to said mount;

a vertically movable member, fitted to piston rods jutting upwardly from the top of said hydraulic cylinders, which extends in the horizontal direction;

a chucking device with a pair of chucking fingers movable toward or away from each other in the lateral direction, said chucking device being attached to said vertically movable member via a guide rod and free to move vertically;

an elastic member installed between said vertically movable member and said chucking device such that said chucking device can be urged downwardly;

a hydraulic cylinder mounted on said device to move said chucking fingers towards or away from each other;

and at least one longitudinal vibrator attached to said vertically movable member at a position between said vertically movable member and said chucking device; said chucking device being located so that a pile held upright can be inserted sidewise into position between said two chucking fingers.

2. The pile or sheet-pile driver of claim 1, wherein a laterally open space for sidewise insertion of an upright pile between the chucking fingers is provided in the mount and in a member installed between the mount and the vertically movable member.

3. The pile or sheet-pile driver of claim 2, including a guide rod supported to move within specified range in vertical direction, relative to the vertically movable member; a support member with a pile-receiving space opening in the same direction as pile insertion supported by said guide rod; said chucking device being fitted to said support member; said chucking device being supported by said vertically movable member via said elastic member installed through a spring bearing plate between said vertically movable member and said support member; said at least one longitudinal vibrator being installed betweeen said spring bearing plate and said vertically movable member.

4. The pile or sheet-pile driver of claim 3, wherein longitudinal vibrators are installed on both sides of the pile-receiving space.

5. The pile or sheet-pile driver of claim 4, including longitudinal vibrators consisting of a hydraulic cylinder with piston rod and a rotary valve to supply the cylinder with the oil for reciprocation of the piston rod, said rotary valve having an input shaft; a motor and motor output shaft attached to said vertically movable member and the rotary valve input shaft, said shafts being interlocked by a belt stretched over a plurality of pulleys in U-letter fashion in the pile-receiving space.

6. The pile or sheet-pile driver of one of claims 3 or 5, wherein one chucking finger is carried on said support member in opposition to the pile-receiving space; said hydraulic cylinder as the drive means is fitted to said support member with the tip of the piston rod directed toward said chucking finger; and the other chucking finger is fitted to the forward end of said hydraulic cylinder; said chucking device being supported by the vertically movable member.

7. The pile or sheet-pile driver of claim 6, wherein a plurality of chucking devices are arranged one above another.

8. The pile or sheet-pile driver of claim 7, including an approximately U-letter chucking fixture fitted to move freely a small distance in the axial direction of the hydraulic cylinder, said chucking fingers and the hydraulic cylinder being supported by said fixture.

9. The pile or sheet-pile driver of claim 6, wherein a pair of chucking fingers are formed approximately in a semi-arc and the gap between said fingers at one pile-insertion side is made wider than the gap at the opposite side.

10. The pile or sheet-pile driver of claim 1, wherein the mount is composed of a fixed member fixable to other members, a slidable member free to move in the direction of the chucking finger movement fitted to said fixed member, and a hydraulic cylinder installed between said fixed member and said slidable member.

11. The pile or sheet-pile driver of claim 6, wherein a lateral vibrator is inserted between said chucking device and said support member so that a lateral vibration can be generated in the moving direction of said chucking device.

12. The pile or sheet-pile driver of claim 1, wherein the chucking device, juts out laterally from between the vertically movable member and the mount and is supported by the vertically movable member such that a pile held upright can be inserted sidewise into position between said chucking fingers.

13. The pile or sheet-pile driver of claim 12, including a guide rod supported, free to move to a certain extent in vertical direction, by the vertically movable member and a support member supported by said guide rod with a laterally opening pile-receiving space provided between the vertically movable member and said mount; said chucking device being attached to said support member, in opposition to said pile-receiving space; said elastic member being inserted via a spring bearing plate between said vertically movable member and said support member; said chucking device being supported by said vertically movable member, and said at least one longitudinal vibrator being installed between said spring bearing plate and said support member.

* * * * *